United States Patent [19]

Cordes

[11] Patent Number: 5,046,761

[45] Date of Patent: Sep. 10, 1991

[54] TELESCOPABLE VACUUM-CLEANER SUCTION PIPE

[75] Inventor: August Cordes, Sundern-Hachen, Fed. Rep. of Germany

[73] Assignee: Carl Froh Rohrenwerk GmbH & Co., Sundern/Hachen, Fed. Rep. of Germany

[21] Appl. No.: 526,229

[22] Filed: May 18, 1990

[30] Foreign Application Priority Data

May 20, 1989 [DE] Fed. Rep. of Germany ..... 3916531

[51] Int. Cl.[5] ..... F16L 21/00

[52] U.S. Cl. ..... 285/7; 285/318; 285/316; 285/119; 403/108

[58] Field of Search ..... 285/7, 119, 318, 319, 285/903, 315, 316, 320; 403/108, 109, 328

[56] References Cited

U.S. PATENT DOCUMENTS

| | | | |
|---|---|---|---|
| 2,885,223 | 10/1956 | Duff | 285/7 |
| 3,244,437 | 1/1964 | Belicka et al. | 285/7 |
| 3,351,359 | 12/1964 | Ferraris | 285/7 |
| 3,351,363 | 12/1964 | Downey et al. | 285/316 |
| 4,055,359 | 10/1977 | McWethy | 285/318 |
| 4,079,965 | 3/1978 | Moughty et al. | 285/319 |
| 4,904,002 | 2/1990 | Sasa et al. | 285/318 |

FOREIGN PATENT DOCUMENTS

| | | |
|---|---|---|
| 3718578 | 6/1987 | Fed. Rep. of Germany . |
| 8906288 | 10/1989 | Fed. Rep. of Germany . |

*Primary Examiner*—Peter M. Cuomo
*Assistant Examiner*—Timothy Aberle
*Attorney, Agent, or Firm*—Herbert Dubno

[57] ABSTRACT

A vacuum-cleaner pipe has an inner tube telescopingly received in an enlarged end of an outer tube. A retaining element diametrically opposite a slider which can be operated by the user can be received in an annular space between the tubes and on opposite sides of a guide body around which, in at least a partial turn, extends a bar spring which is braced against the guide body and not only provides the bias to the retaining element in the direction in which it presses a detent into a selected recess of a detent strip of the inner tube, but also forms the coupling between the slider and the retaining element so that upon movement of the slider in one direction, the retaining element is moved in the opposite direction.

9 Claims, 3 Drawing Sheets

TELESCOPABLE VACUUM-CLEANER SUCTION PIPE

FIELD OF THE INVENTION

My present invention relates to a telescopable vacuum-cleaner suction pipe, i.e. a suction pipe for a dust-pickup suction device, of the type in which an outer tube receives an inner tube which is prevented from rotation within the outer tube and wherein a detent body can be held in a selected recess of a detent strip formed on the wall of the inner pipe by a retaining element in the enlarged end of the outer pipe and a slider can be manipulated by the user to displace the retaining element against this spring bias to release the detent body from its recess.

BACKGROUND OF THE INVENTION

A telescopable vacuum-cleaner pipe of the type in which the invention is directed has been described in German patent 37 18 578, reference being had specifically to column 6, lines 49-65 of that patent.

In the system there described, the detent strip, i.e. the row of detent recesses and the slider which can be manipulated by the user are provided on diametrically opposite sides of the circumference of the vacuum-cleaner suction pipe.

For mechanical coupling of the slider and the retaining element which allows the displacement of the detent body, a stirrup is provided with two longitudinal shanks guided within a guide body filling the annular space between the cylindrical enlargement of the outer tube and the inner tube. The retaining element is displaced by this stirrup against a restoring force generated by two springs and which bias the retaining element into its retaining position. In the retracted position of the retaining element, against the force of these two springs, the detent body can disengage from a recess to allow telescoping displacement, i.e. relative axial displacement of the inner and outer tubes.

The telescopable vacuum-cleaner suction pipe of this system has the esthetic advantage that the detent strip is generally out of sight from the user because it is provided on the downwardly turned side or the underside of the pipe, i.e. the side opposite that at which the slider is visible.

However, the described construction is relatively complex and difficult to assemble.

OBJECTS OF THE INVENTION

It is, therefore, the principal object of the present invention to provide a vacuum-cleaner suction pipe or, more generally, a suction pipe for a dust-collecting apparatus operating by vacuum, which retains the advantage of the aforedescribed prior-art system but is free from the disadvantages thereof.

Another object of my invention is to provide a suction pipe for the purposes described in which the detent strip is not readily visible and which thus has an esthetic character, but which is of simple construction and can be more easily assembled than the earlier system.

SUMMARY OF THE INVENTION

These objects and others which will become apparent hereinafter are attained, in accordance with the present invention in a telescopable vacuum-cleaner suction pipe having an outer tube with a cylindrical enlarged head and an inner tube telescopingly received in the outer tube at this enlarged end, secured against relative rotation with respect to the outer tube but axially shiftable therein, and formed with a detent strip of detent recesses embossed or indented in a wall of the inner tube, a detent body in the annular space defined between the enlarged end and the inner tube being engageable selectively in one of these recesses and being held therein by a spring-biased retaining element which is coupled with a slider which, together with the guide body, the retaining element and the spring biasing the retaining element, are received in the annular space and wherein the slider and detent strip are on diametrically opposite sides of the suction pipe.

According to the invention, the retaining element is disposed directly adjacent the detent strip within the annular space, the guide body holds under stress one or both ends of a bar or rod spring forming the spring bias to the retaining element, the bar spring extends at least partly around the guide body within the annular space and the bar spring further couples the slider, which extends through the wall of the cylindrical enlargement with the retaining element to enable actuation of the retaining element by the slider.

More specifically, the suction pipe of the invention comprises:

an outer tube formed with a generally cylindrical enlarged end;

an inner tube received in the enlarged end of the outer tube and having a wall portion formed with a detent strip having a row of outwardly opening detent recesses axially spaced along the inner tube, the enlarged end of the outer tube defining with the inner tube an annular space;

a detent body in the annular space shiftable into a selected one of the recesses for retaining the inner tube in place within the outer tube;

a retaining element in the space adjacent the strip slidable axially relative to the detent body and positioned to retain the detent body in a selected one of the recesses in one position of the retaining element and to release the detent body from a recess in another position of the retaining element;

a guide body received in the space between the tubes;

a slider axially shiftable in the space on the guide body and protruding through an opening formed in the enlarged end for manual displacement by a user, the slider being located diametrically opposite the strip across the pipe;

a bar spring in the space having at least one end braced against the guide body, extending in at least a partial turn at least partly around the guide body in the space, and resiliently urging the retaining element into the one position thereof, the bar spring coupling the slider and the retaining element for shifting of the retaining element into the other position upon actuation of the slider.

The individual springs, for example coil springs, hitherto required in the earlier construction, are eliminated with the system of the present invention which makes use of a bar-type or rod-type spring which extends at least in a partial turn at least partially around the guide body.

At least one end of this bar spring is engaged by the guide body to provide any prestress required for the spring bias of the retaining element into its aforementioned one position in which it holds the detent body in place. In addition, the bar spring provides the requisite mechanical coupling between the retaining element and the slider for actuation of the former by the latter in spite of the fact that they lie on diametrically opposite sides of the pipe. The bar spring is prestressed in the direction of movement of the retaining element which urges the detent body into engagement in a recess.

A further advantage of the system of the invention is that the bar spring does not require any special guide passages as has been necessary heretofore in the actuation member of earlier suction pipes to pass or accommodate the coil compression of the springs, since the bar spring passes around the guide body and between the guide body and the inner surface cylindrical enlargement.

The additional structural simplification arises from the fact that the bar spring also forms the mechanical coupling between the slider and the retaining element by contrast to the system.

According to a feature of the invention, the bar spring extends along a segment of a helix so that it in part lies in a plane which is inclined to a radial plane of the pipe.

In this manner I am able to generate the desirable prestress in the bar spring utilizing a clamped end thereof extending parallel to the pipe axis and which can be located adjacent an overlapping zone between portions of the turn which thus can extend fully around the circumference of the guide body. In the overlapping zone, a relative movement of the overlapped portions of the bar spring is permissible when the latter is displaced by the slider.

According to a feature of the invention, the overlapping zone of the bar spring is located between free ends of two finger-like ribs formed on the guide body parallel to the axis of the pipe and axially spaced apart in the overlapping region. The ends of the bar spring can be braced against these ends of the ribs.

It is advantageous, moreover, to form the overlapping zone in the direct vicinity of the ends of the bar spring helical turn which are braced against these ribs.

At least one of these ends can have a portion extended parallel to the axis and lying alongside the respective rib.

According to a further feature of the invention, the guide body can be formed with an axially extending groove in a portion of that body opening radially outwardly, i.e. a shoulder of that body. The outwardly open groove can receive an axially-extending end of the bar spring.

According to another feature of the invention, for ease of assembly, the retaining element can be formed with a groove generally transverse to the axis of the pipe and receiving the bar spring while the slider can have a portion formed with an outwardly open groove transverse to the axis of the pipe and receiving the bar spring.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
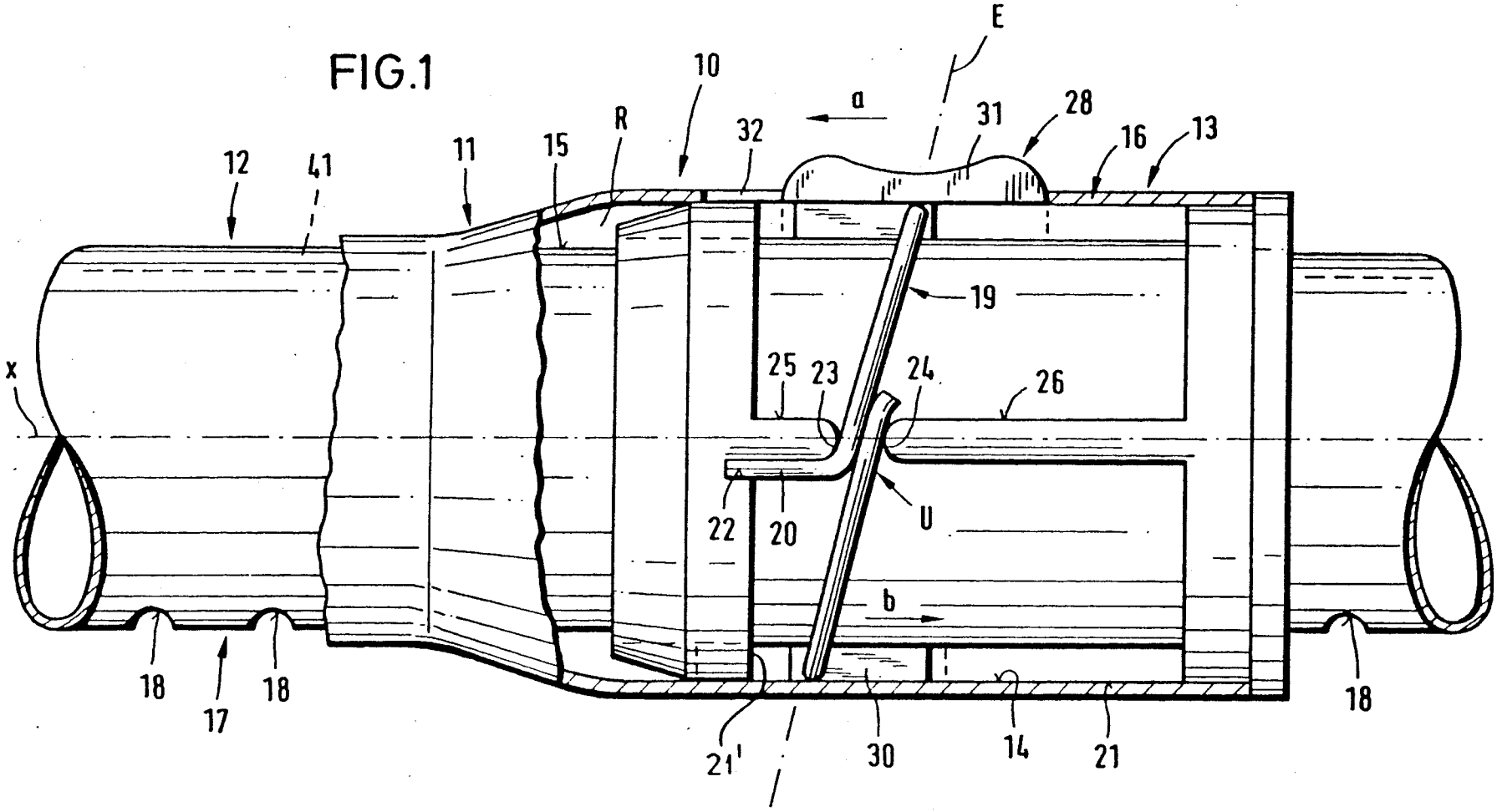
FIG. 1 is an elevational view, partly broken away, showing a vacuum-cleaner suction pipe according to the invention.

The telescopable vacuum-cleaner suction pipe 10 shown in the drawing comprises an outer tube 11, which has only been illustrated at its enlarged end, and an inner tube 12 which can be telescopingly displaced into and out of the outer tube.

The outer tube 11 is formed with a helical enlargement 13 whose inner surface 14 defines with the outer surface 15 of the inner tube 12, an annular space R.

The greater part of the annular space R is filled by a guide body 16, for example, an injection-molded plastic structure, this body 16 also serves to seal the gap between the inner and outer tubes so that ambient air will not be drawn into the junction between them.

The inner tuber 12 is provided with a detent strip 17 which is comprised of a row of successive detent indentations or recesses 18 parallel to the axis of the pipe and spaced apart from one another. The tube axes correspond to the longitudinal axis of the pipe and all have been designated at x. From FIG. 1, the relationship of the parts to a bar spring 19, which can consist of a circular-cross section spring steel rod, is readily visible.

The bar spring 19 is wound in somewhat more than a full helical turn around the guide body 16 so that the bar spring lies, for the most part, in a plane E which is inclined to the radial planes of the suction pipe 10.

An end 20 of the bar spring 19 extends parallel to the pipe axis x and is received in an outwardly open radial groove 22 which extends axially in an outer shoulder 21' of the guide body 16 which has an outer surface 21. To increase the prestress applied to the bar spring 19, the two ends of the latter can be held by respective clamping parts of the guide body. The prestressing force, of course, can also depend upon the selection of different spring wire thicknesses or can be varied by kinking or selectively bending the spring wire.

The ends of the bar spring 19 form an overlapping zone U between the free ends 23 and 24 of two generally finger-like ribs 25 and 26 which are spacedly juxtaposed and extend parallel to the pipe axis x on the guide body 16. From FIG. 1 it will be apparent that the overlapping zone U is directly adjacent the clamped end 20 of the bar spring which extends parallel to the pipe axis x.

Figure 2:
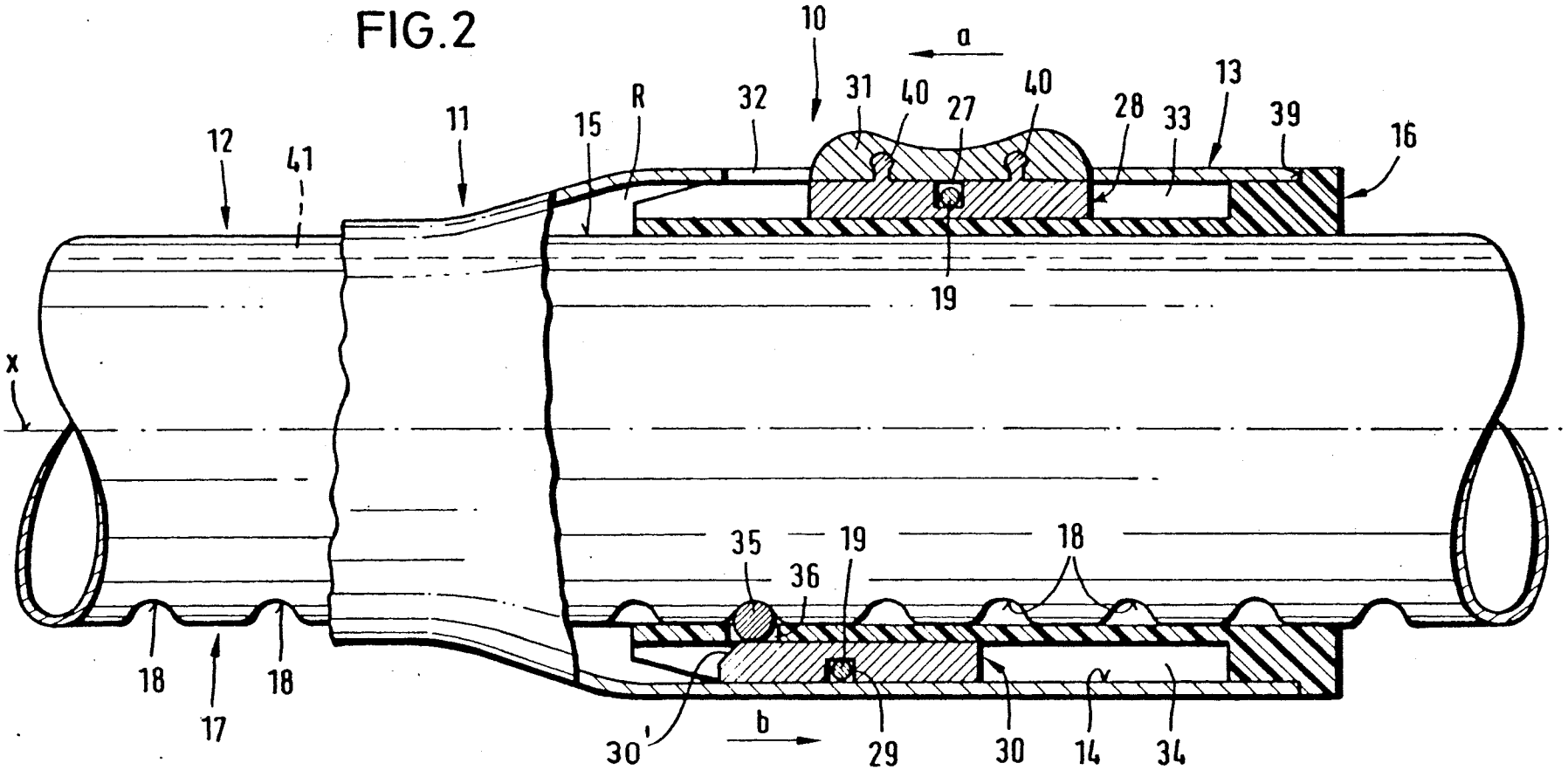
FIG. 2 is a view similar to FIG. 1 showing the guide body, the detent body, the retaining element, the slider and the bar spring in axial section and with the detent body held in a recess of the inner pipe.
Figure 3:
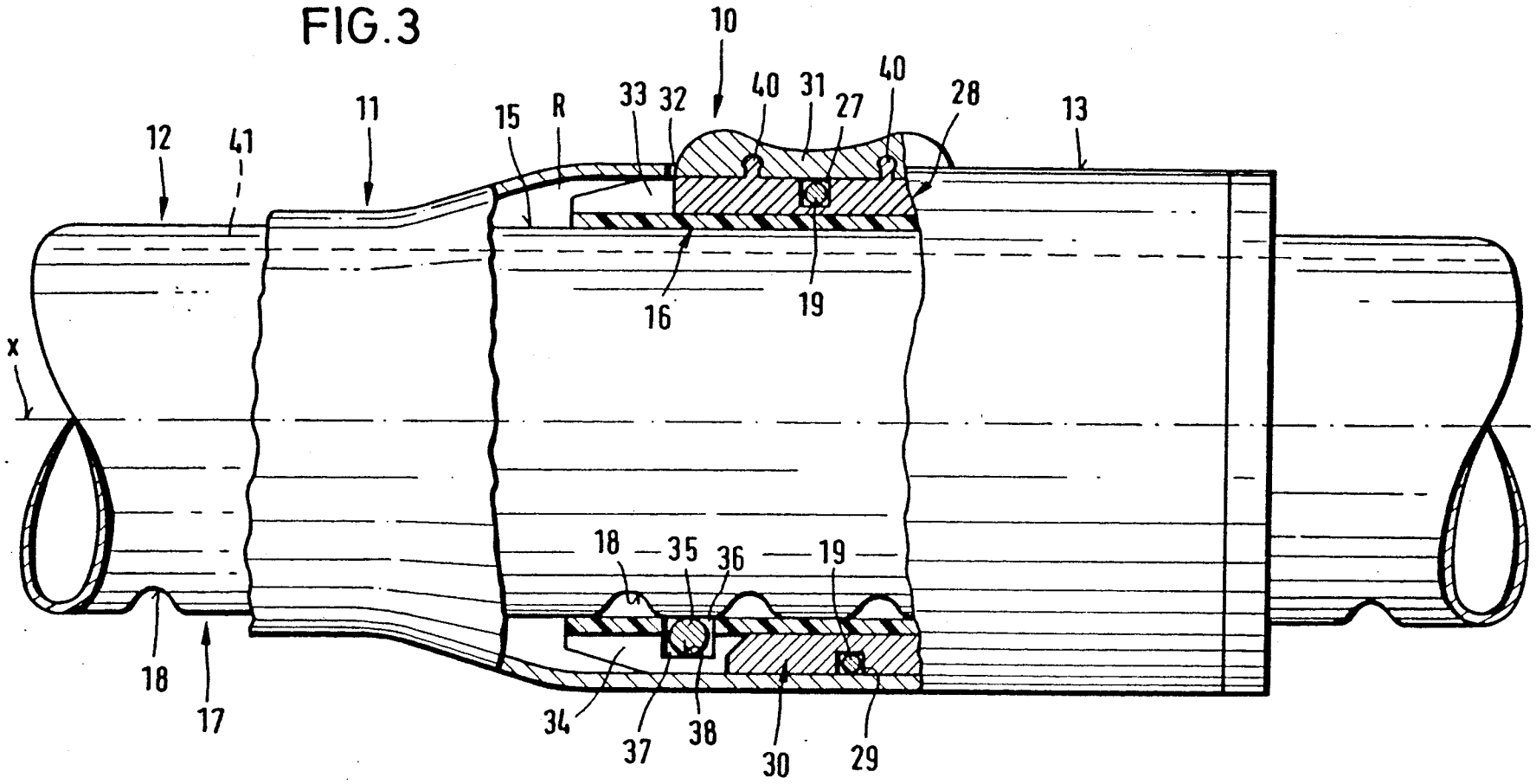
FIG. 3 is a view similar to FIG. 2 but showing the positions of the bar spring, the slider, the retaining element and the detent body when the latter is released from its recess.

As can be seen from FIGS. 2 and 3, the bar spring 19 is engaged in an outwardly open transverse groove 27 of the slider 28 and in an outwardly open transverse groove 29 of the retaining element 30. The slider 28 extends through a guide slit 32 in the form of a slider actuator body 31 which has a trough shape and can be ridged or ribbed transversely of the axis of the pipe to enable it to be engaged securely by the thumb of the user.

Member 31 is connected in turn by formations 40 with a slider body 31' shiftable in a channel 33 parallel to the pipe axis x.

Diametrically opposite the channel 33, the guide pipe 16 is formed with a guide channel 34 in which the retaining element 30 is axially displaceable.

The retaining element 30 has a ramp surface 30' which can engage a roller-type detent body 35 which is radially shiftable in an opening 36 formed in the guide body. In the position of the retaining element 30 shown in FIG. 3, the roller body 35 can drop out of a recess 18 to allow telescoping displacement of the two tubes. The bar spring 19, however, biases the retaining element 30 into the position shown in FIG. 2 in which it cams the detent 35 into one of the recesses 18 when, for example, the slider is released.

The detent body 35 is received at its opposite ends in respective guide passages 37 turned toward the guide body and provide an outer abutment 38 preventing the detent from falling out of position. The two substantially radially-extending guide passages 37, of course, lie out of the path of axial movement of the retaining element 30.

The vacuum-cleaner suction pipe 10 is operated as follows:

When the slider 28 is shifted in the direction of the arrow a as illustrated in FIGS. 1 and 2, the ends 23 and 24 form fulcra for the spring 19 and transmit a motion in the opposite direction b to the retaining element 30, thereby shifting the retaining element from its locking position shown in FIG. 2 into the position shown in FIG. 3, i.e. the unblocking position. The motion in the unblocking position thus is effected against the restoring force of the bar spring 19.

The detent 35 can then drop out of its recess 18 against the abutment 38 to permit telescoping movement of the device.

Upon release of the thumb from the slider 28, the spring action returns the retaining element 30 to the left to press the detent 35 into another recess 18 when such recess comes into position.

The drawings also make it clear that the bar spring 19, the slider 38, the retaining element 30 and the guide body 16 form an assembly which can be mounted as a unit in the enlarged end of the outer pipe. This can be achieved by simply inserting the detent 35 in the assembly and placing the assembly on the inner tube 12 so that the detent strip 17 is engaged. The enlargement 13 of the outer tube can then be fitted over the assembly until its free end engages the annular shoulder 39 (FIG. 2) of the guide body. The member 31 is thereupon fitted onto the pins 40 of the slider 28 by a snap action.

A groove 41 is formed in the inner tube 12 and cooperates with a spring-like projection, not shown, on the guide body 16 to prevent rotation of the inner tube relative to the outer tube and to the guide body.

I claim:

1. A telescopable vacuum-cleaner pipe, comprising:

an outer tube formed with a generally cylindrical enlarged end;

an inner tube received in said enlarged end of said outer tube and having a wall portion formed with a detent strip having a row of outwardly opening detent recesses axially spaced along said inner tube, said enlarged end of said outer tube defining with said inner tube an annular space;

a detent body in said annular space shiftable into a selected one of said recesses for retaining said inner tube in place within said outer tube;

a retaining element in said space adjacent said strip slidable axially relative to said detent body and positioned to retain said detent body in a selected one of said recesses in one position of said retaining element and to release said detent body from a recess in another position of said retaining element;

a guide body received in said space between said tubes;

a slider axially shiftable in said space on said guide body and protruding through an opening formed in said enlarged end for manual displacement by a user, said slider being located diametrically opposite said strip and said retaining element across the pipe;

a bar spring in said space having at least one end braced against said guide body, around said guide body in said space, and resiliently urging said retaining element into said one position thereof, said bar spring coupling said slider and said retaining element for shifting of said retaining element into said other position upon actuation of said slider, said bar spring having an overlapping portion between ends thereof at an overlap zone along the periphery of said guide body and extends at least a full turn therearound, said overlap zone being disposed between free ends of a pair of axially-spaced parallel finger-like ribs formed on said guide body and extending parallel to an axis thereof.

2. The telescopable vacuum-cleaner pipe defined in claim 1 wherein said zone is directly adjacent at least one end of said bar spring.

3. The telescopable vacuum-cleaner pipe defined in claim 1 wherein said bar spring extends along at least a segment of a helix.

4. The telescopable vacuum-cleaner pipe defined in claim 1 wherein said bar spring engages in a transverse groove formed in said retaining element.

5. The telescopable vacuum-cleaner pipe defined in claim 1 wherein said bar is received in an outwardly open groove formed in said slider.

6. The telescopable vacuum-cleaner pipe defined in claim 2 wherein said one end of said bar spring extends parallel to an axis of the pipe.

7. The telescopable vacuum-cleaner pipe defined in claim 3 wherein said bar spring lies in a plane inclined to a radial plane of said pipe.

8. The telescopable vacuum-cleaner pipe defined in claim 6 wherein said one end is received in an outwardly open axially-extending radial groove formed in an outer surface of said guide body for stressing said bar spring.

9. A telescopable vacuum-cleaner pipe, comprising:

an outer tube formed with a generally cylindrical enlarged end;

an inner tube received in said enlarged end of said outer tube and having a wall portion formed with a detent strip having a row of outwardly opening detent recesses axially spaced along said inner tube, said enlarged end of said outer tube defining with said inner tube an annular space;

a detent body in said annular space shiftable into a selected one of said recesses for retaining said inner tube in place within said outer tube;

a retaining element in said space adjacent said strip slidable axially relative to said detent body and positioned to retain said detent body in a selected one of said recesses in one position of said retaining element and to release said detent body from a recess in another position of said retaining element;

a guide body received in said space between said tubes;

a slider axially shiftable in said space on said guide body and protruding through an opening formed in said enlarged end for manual displacement by a user, said slider being located diametrically opposite said strip and said retaining element across the pipe;

a bar spring in said space having at least one end braced against said guide body, extending in at least a partial turn at least partly around said guide body in said space and engaged by said guide body between said slider and said retaining element, and resiliently urging said retaining element into said one position thereof, said bar spring coupling said slider and said retaining element for axially opposite movements across said guide body, and said bar spring being disposed between free ends of a pair of axially spaced parallel finger-like ribs formed on said guide body and extending parallel to an axis thereof for shifting of said retaining element into said other position upon actuation of said slider.

* * * * *